US005864060A

United States Patent [19]

Henderson et al.

[11] Patent Number: 5,864,060

[45] Date of Patent: Jan. 26, 1999

[54] METHOD FOR MONITORING THE WORK CYCLE OF MOBILE MACHINERY DURING MATERIAL REMOVAL

[75] Inventors: Daniel E. Henderson, Washington; Gregory R. Harrod, Peoria, both of Ill.

[73] Assignee: Caterpillar Inc., Peoria, Ill.

[21] Appl. No.: 827,429

[22] Filed: Mar. 27, 1997

[51] Int. Cl.[6] ..... G01F 15/14; E02F 5/02; H04B 7/185

[52] U.S. Cl. ..... 73/432.1; 364/424.07; 342/357; 37/348

[58] Field of Search ..... 364/424.07; 342/357; 37/348; 73/432.1

[56] References Cited

U.S. PATENT DOCUMENTS

| | | | |
|---|---|---|---|
| 3,979,731 | 9/1976 | Naplatanov et al. | 340/172.5 |
| 5,404,661 | 4/1995 | Sahm et al. | 37/348 |
| 5,438,771 | 8/1995 | Sahm et al. | 37/348 |
| 5,471,391 | 11/1995 | Gudat et al. | 364/424.07 |
| 5,493,494 | 2/1996 | Henderson | 364/424.07 |
| 5,612,864 | 3/1997 | Henderson | 364/167.01 |
| 5,631,658 | 5/1997 | Gudat et al. | 342/457 |
| 5,646,844 | 7/1997 | Gudat et al. | 364/449.2 |

*Primary Examiner*—Michael Brock
*Assistant Examiner*—Jay L. Politzer
*Attorney, Agent, or Firm*—W. Brian McPherson

[57] ABSTRACT

The invention is a method for monitoring a work cycle of a mobile machine on a land site. The mobile machine has a bucket and a body that is adapted to rotate about a fixed point of reference. The method includes the steps of determining an angular velocity of the body, determining the body is stopped based on the angular velocity, determining a duration of time the body is stopped, and determining the work cycle in response to the duration of time the body is stopped.

17 Claims, 6 Drawing Sheets

METHOD FOR MONITORING THE WORK CYCLE OF MOBILE MACHINERY DURING MATERIAL REMOVAL

TECHNICAL FIELD

This invention relates to the monitoring of material removal from a work site and, more particularly, to monitoring the work cycle of mobile machinery on a land site.

BACKGROUND ART

The process of removing material from land sites such as mines has been aided in recent years by the development of commercially available computer software for creating digital models of the geography or topography of a site. These computerized site models can be created from site data gathered by conventional surveying, aerial photography, or, more recently, kinematic GPS surveying techniques. Using the data gathered in the survey, for example point-by-point three-dimensional position coordinates, a digital database of site information is created which can be displayed in two or three dimensions using known computer graphics or design software.

For material removal operations such as mining it is desirable to add additional information to this database. Core samples are frequently taken over a site in order to categorize and map the different types and locations of material such as ore, as well as the different concentrations or grades within a given ore type.

Using the above information, a mine plan can be developed. The mine plan can include an evaluation of the amount of topsoil to remove and stockpile or spread for reclamation, and identification of the amount of overburden required to be moved in order to mine the ore. Finally, the plan may include the method with which the actual ore will be mined and removed.

The economy of the mining operation is largely determined by the amount of product processed from the ore removed. To meet output requirements, identification of economical ore concentrations to be processed is important. It is therefore desirable to establish well defined boundaries for the various types and grades of ore to be mined from the site which can be efficiently processed with current methods.

Generally a resource map of the site and the material to be mined is generated with boundaries corresponding to the different types and grades of ore. Surveying and stake setting crews mark the site itself with corresponding flags or stakes.

The mining of the ore is accomplished with mobile or semi-mobile loading machinery equipped with a tool such as a bucket. The loader removes the ore as indicated by the stakes and loads it one bucket at a time into a truck, for example. When the truck is filled, the truckload of ore is transported from the site for processing or stockpiling.

During the loading operation the flags or stakes marking out the various types and grades of ore are vulnerable and are easily disturbed. It may also be difficult for the operator to see the flags, depending on the available light or weather. Additionally, there may be several marked sections that look similar to the mapped area which the operator is trying to locate from the paper copy of the site model.

Since mines are typically set up to handle a given amount of material of given ore concentrations, errors in loading the wrong material from the site can be costly. If a mine inadvertently provides a mill or processing plant with material that is out of specification regarding the concentration of ore, the mine may be liable for compensating the plant for any related production consequences.

Therefore, two fundamental issues involved with mining a land site are knowing the work cycle of the mobile machine, e.g. when it is loading and dumping material, and what type of material is being mined. There are currently some solutions to this. However these solutions consist of using expensive sensors such as payload monitoring systems to determine when the bucket is being loaded, and using one or more GPS sensors located on the bucket to determine the position of the bucket on the work site. Since reducing the cost of mine operation is a primary concern, a low cost solution to monitoring the work cycle of a mobile machine, and the type of material being loaded is desired.

The present invention is directed to overcoming one or more of the problems as set forth above by monitoring the work cycle of a mobile machine on a land site.

DISCLOSURE OF THE INVENTION

In one aspect of the present invention, a method for monitoring a work cycle of a mobile machine on a land site is provided. The mobile machine includes a bucket and a body that rotates about a fixed point of reference. The method includes the steps of determining an angular velocity of the body, when the body stops, and a duration of time the body is stopped. Finally, the method determines the particular work cycle in response to the duration of time that the body is stopped.

BEST MODE FOR CARRYING OUT THE INVENTION

Figure 1:
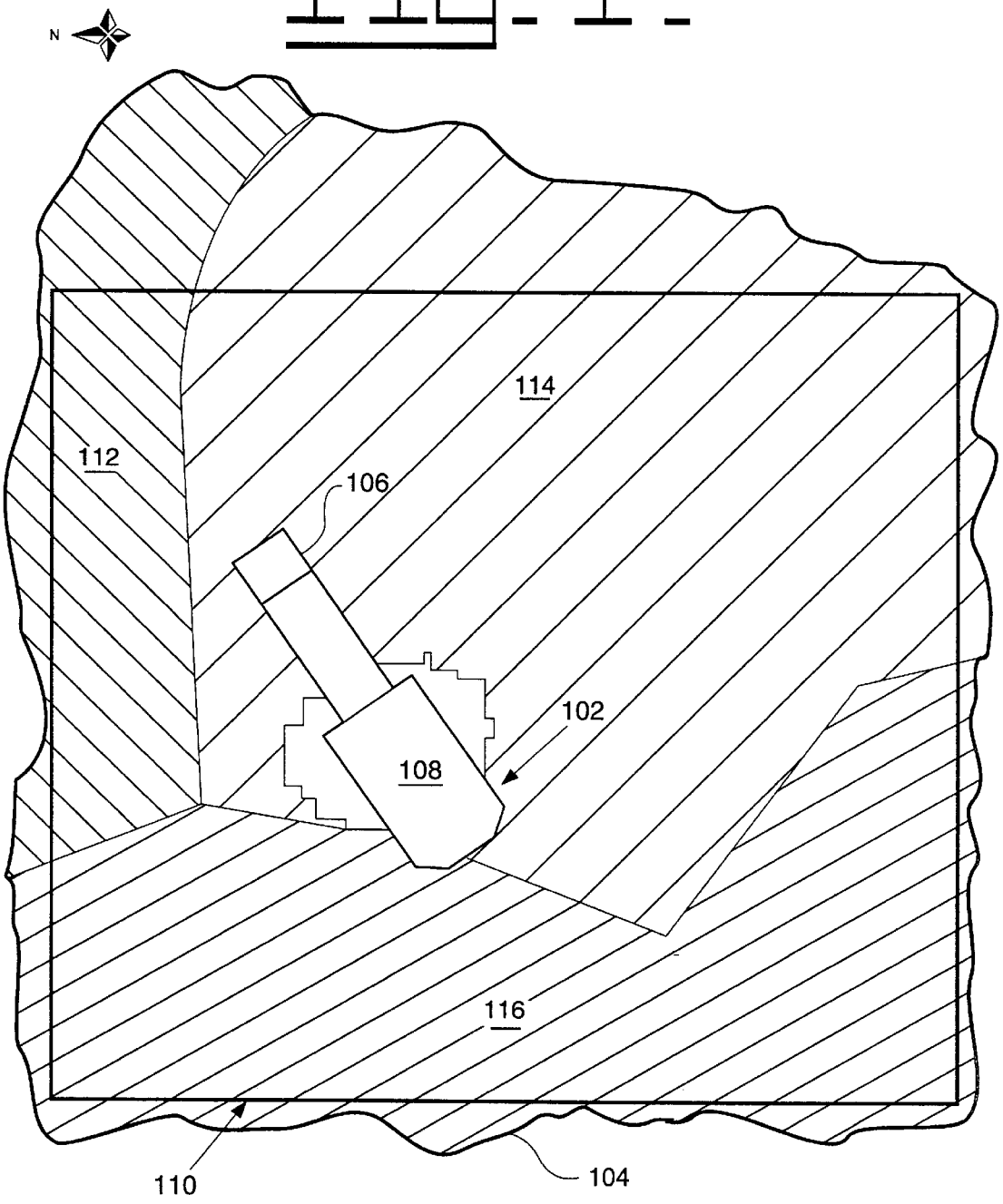
FIG. 1 is a high level diagram of a resource map containing a land site and a mobile machine.

The current invention provides a method for monitoring the work cycle of a mobile machine on a land site. FIG. 1 is an illustration of a mobile machine 102 on a land site 104. The mobile machine 102 has a bucket 106, a body 108 that rotates about a fixed point of reference, and a base (not shown). In the preferred embodiment the mobile machine 102 includes a cable shovel; however, other types of mobile machines are equally applicable, such as a hydraulic shovel, an excavator, etc. In the case of a cable shovel, the base includes tracks or crawlers (not shown). The land site 104 may be depicted in a resource map 110 which indicates the topography and type of material at a given location on the land site 104. For example, the resource map 110 of FIG. 1 illustrates a land site 104 containing a first and second material type 112, 114, and a region 116 of unknown material type. The first and second material types 112, 114 may be different material types, or the same material type containing different concentrations of the material. As the cable shovel 102 travels through the land site 104 loading material, the resource map 110 is updated to indicate whether a location has been mined, and if so, updates the topography at the location. A location has been mined if all of the desired material from the location has been loaded.

Figure 2:
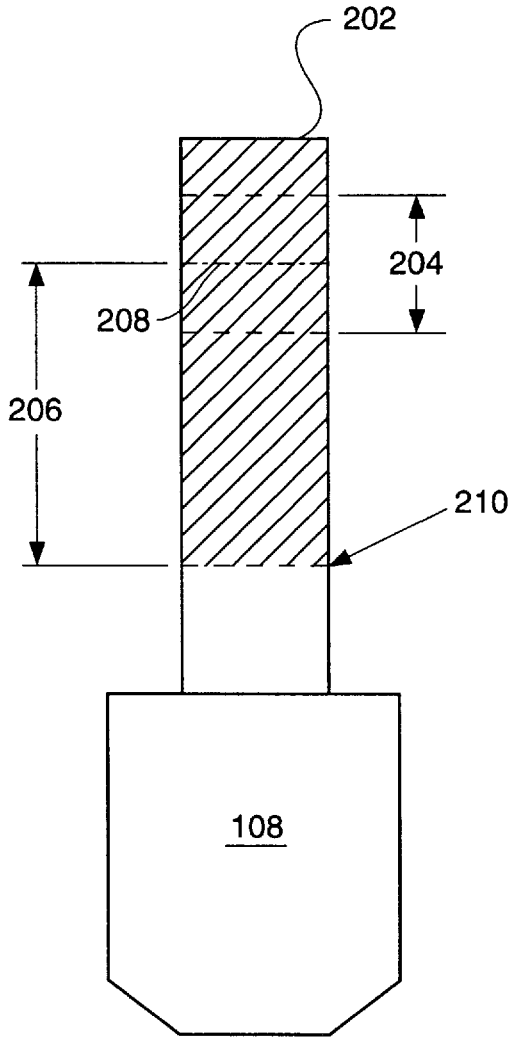
FIG. 2 is a diagram illustrating the load regions of a mobile machine.

When a loading or dumping operation has been performed during the work cycle, it is necessary to identify the type of material that the cable shovel 102 loaded. One method of identifying the material type loaded, explained later, involves defining a potential load region of the body 108 of the cable shovel 102. FIG. 2 is an illustration of a potential load region 202. The potential load region 202 represents the portion of the land site 104 where the cable shovel 102 may have loaded material at a particular time. In the preferred embodiment, the potential load region 202 of a cable shovel 102 extends from the body 108 of the cable shovel 102 to the maximum extension of the bucket 106 while the body 108 of the cable shovel 102 is stopped. The potential load region 202 is located on the same side of the body 108 of the cable shovel 102 as the bucket 106. In the preferred embodiment the potential load region 202 includes a primary and secondary load region 204, 206. The secondary load region 206 is adjacent to the cable shovel 102. The primary load region 204 is located adjacent to the secondary load region 206 opposite the cable shovel 102. As will be described later, the primary and secondary load regions 204, 206, enable a more accurate determination of the work cycle, and a more accurate determination of the type of material being loaded. In the preferred embodiment, the length and width of the primary load region 204 are equal to the width of the bucket 106, and the primary load region 204 is centered on a point sheave line 208 of the cable shovel 102. The secondary load region 206 extends between the point sheave line 208 and a toe swath line 210. The toe swath line 210 is located a distance equal to the edge of the tracks (not shown) of the cable shovel 102 from the center of the body 108, in the direction of the bucket 106. The use of the potential, primary and secondary load regions 202, 204, 206 will be discussed later.

Figure 3:
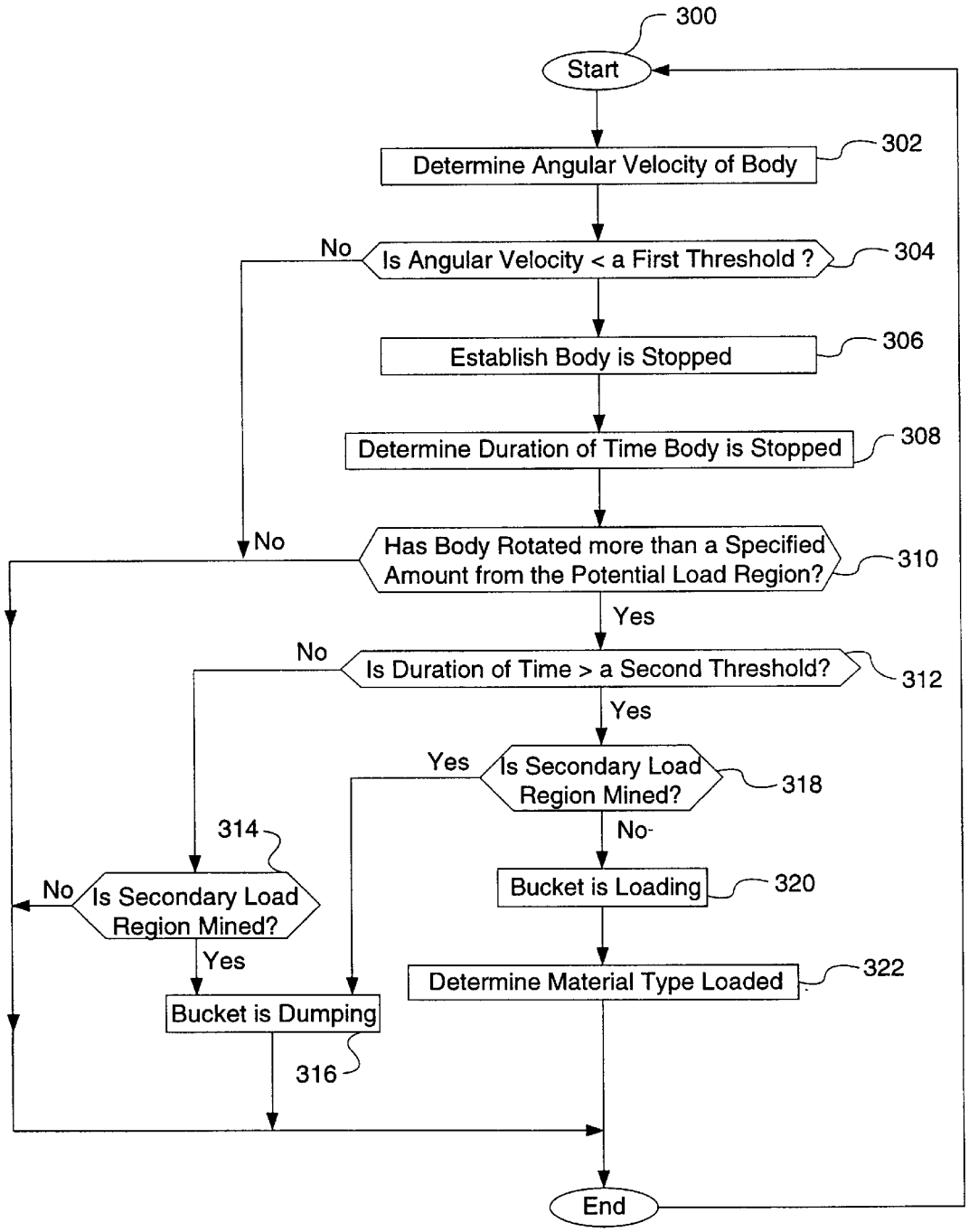
FIG. 3 is a high level flow diagram illustrating a method of the present invention.

Referring now to FIG. 3, a flow diagram illustrating a method 300 for monitoring a work cycle for a mobile machine 102 is shown. In a first control block 302, the angular velocity of the body 102 is determined. In the preferred embodiment the body angular velocity is determined by using a GPS receiver (not shown) located on the body 108 of the cable shovel 102. The GPS receiver receives position updates for the body 102. For example, as the body 102 rotates about a fixed point of reference, the GPS position updates are used to determine the angular velocity. Because the process to receive GPS position updates and determine angular velocity is well known to one skilled in the art, the details will not be expanded upon here.

Upon determining the angular velocity, the method 300 then compares the angular velocity to a first threshold, shown in control block 304. If the angular velocity is less than the first threshold, the body 108 is considered to be stopped, shown in a second control block 306. If the angular velocity is greater than the first threshold, then the body 108 is considered to be in motion, and control passes to the beginning of the method 300. Preferably, a non zero value is used for the first threshold limit to account for some angular movement of the body 108 when the cable shovel 102 is loading the bucket 106. Once the body 108 is stopped, the method 300 determines the duration of time the body 108 is stopped, shown in a third control block 308. Continuing to a second decision block 310, the method 300 determines how far the body 108 has rotated since the body 108 was last stopped. A purpose of this test is to insure that the body 108 is moving away from a potential load region 202 before making a determination regarding whether a loading or dumping operation was just performed. By ensuring the body 108 is moving away, the method 300 can account for false starts, e.g. where the bucket 106 begins to load but has to rotate slightly to account for an object that the bucket 106 encounters. The method 300 determines how far the body 108 has rotated by logging the location of the body 108 when the body 108 is stopped. Using the stopped location as a reference location, the method 300 determines the amount of angular rotation the body 108 performs. If the body 108 rotates far enough away from the potential load region 202, then the method 300 determines that the movement is not a false start and continues with the third decision block 310. Otherwise, control passes to the beginning of the method 300.

Continuing to a third decision block 312, the method 300 determines if the duration of time that the body 108 is stopped is less than a second threshold. The duration of time that the body 108 is stopped is an important metric in determining whether the bucket 106 was loaded or dumped while the body 108 was stopped. For example, there is a minimum load time needed for a cable shovel 102 to load the bucket 106. If the time the body 108 is stopped is less than the minimum load time, then the conclusion is that the bucket 106 was not loaded. In a fourth decision block 314, the method 300 determines if the material in the secondary load region 206 has been mined out, i.e. whether the desired material in the secondary load region 206 been loaded. A determination about whether the secondary load region 206 has been mined out involves the resource map 110. In the preferred embodiment, the resource map 110 is dynamically updated as the cable shovel 102 performs the work cycle. As the body 108 of the cable shovel 102 rotates to load and dump material, a mined update region 402 is updated, as being mined out.

Figure 4:
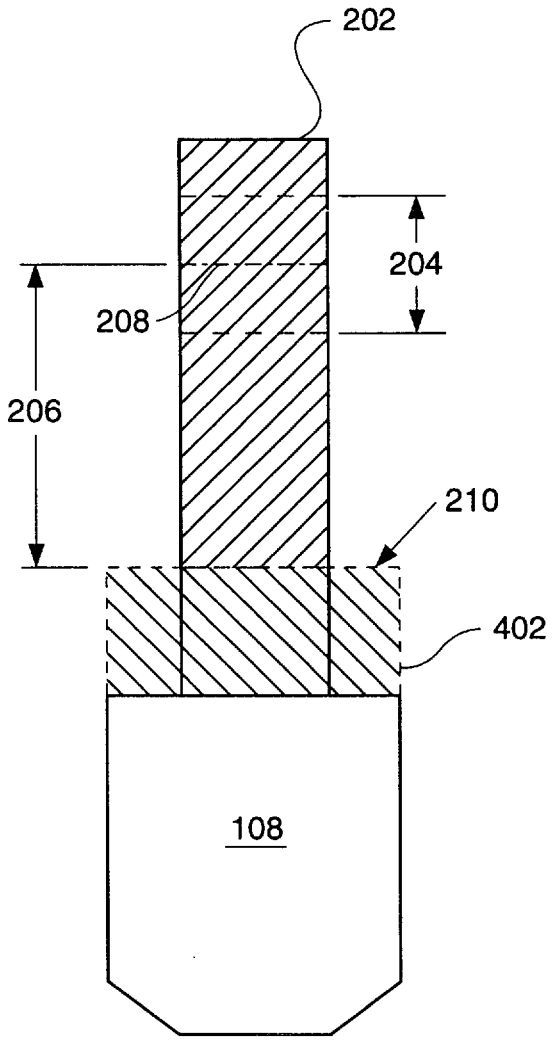
FIG. 4 is a diagram illustrating a mined update region of a mobile machine.
Figure 5:
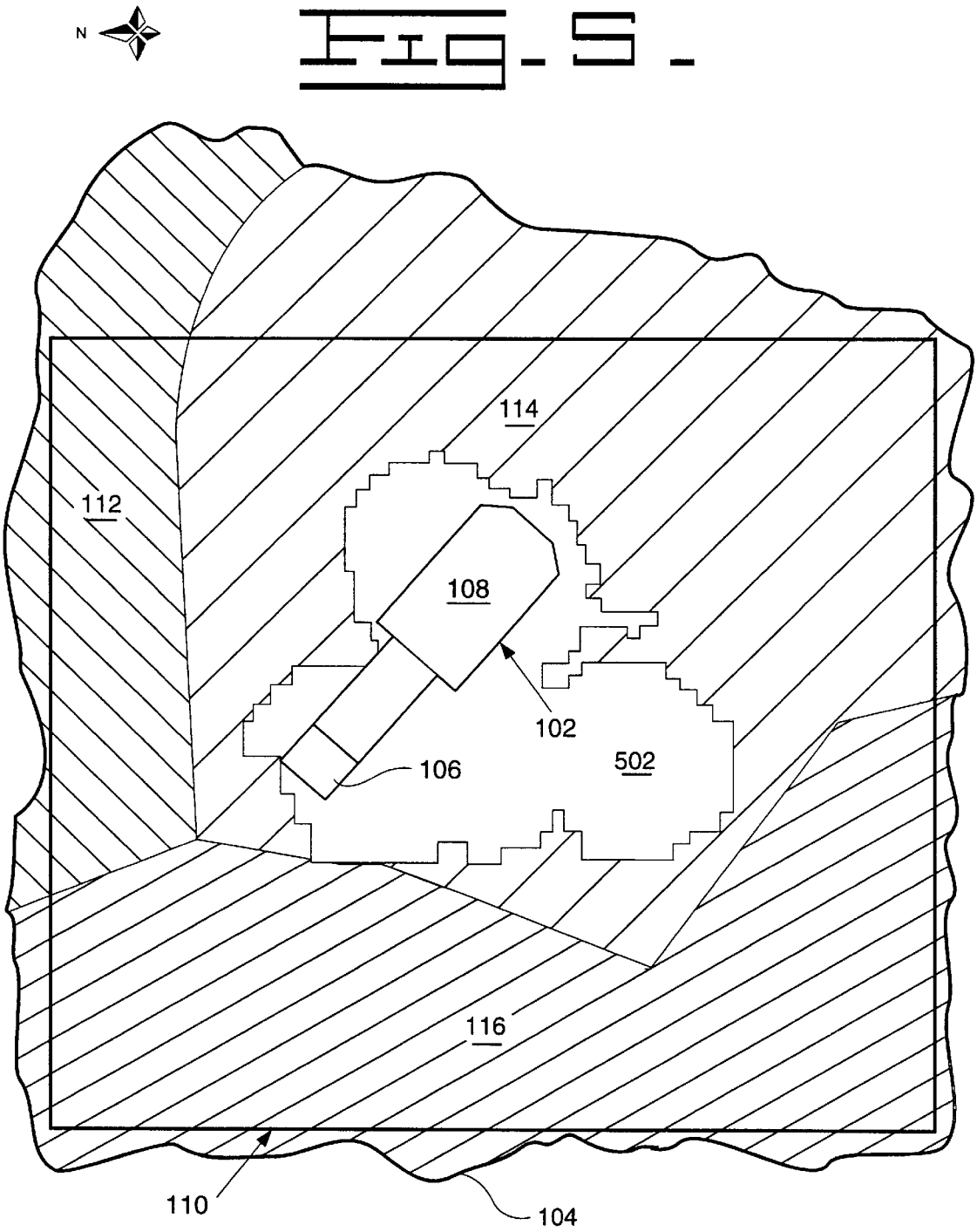
FIG. 5 is a diagram illustrating a mined out region of a land site.

The mined update region 402, illustrated in FIG. 4, is the region of the land site 104 extending from the center of the body 108 a distance equal to the distance between the center of the body 108 and the edge of the tracks of the cable shovel 102 (not shown), in the direction of the bucket 106. The rationale for the mined update region 402 is that for the body 108 to be positioned at a particular location, and physically be able to rotate, the area covered by the mined update region 402 during rotation, including the original position, must be mined out. The resource map 110 continues to be updated during the course of mining the land site 104. FIG. 5 is an illustration of a land site 104 with a mined out region 502. Based on the dynamically updated resource map 110, an accurate determination can be made as to whether a secondary load region 206 has been mined. In the preferred embodiment, if the resource map 110 indicates that over one half of the secondary load region 206 has been mined out, then the secondary load region 206, as a whole, is considered to be mined out.

If the desired material in the secondary load region 206 has been mined, then the method 300 determines that the bucket is dumping material, shown in control block 316, and control passes to the beginning of the process. If the desired material in the secondary load region 206 has not been mined out, then control passes to the beginning of the method 300 with no determination regarding loading or dumping.

If the method 300 determines that the duration of time the body 108 was stopped exceeds the second threshold, shown in the third decision block 312, then a determination is made as to whether the desired material in the secondary load region 206 has been mined out, shown in fifth decision block 318. The rationale of the fifth decision block 318 is that normally, when a body 102 is stopped longer than that indicated by the second threshold, e.g., the minimum load time, then the bucket 106 is loading. However, there are instances when loading did not occur. For example, if the bucket 106 loaded material, and was waiting to dump the material into a truck (not shown), the duration of time the body 108 is stopped will exceed the second threshold. However, in a situation when the duration of time the body 108 is stopped is greater than the second threshold, then determining if the desired material in the secondary load region 202 has been mined out, indicates whether a load or dump is occurring. If the method 300 determines, in the fifth decision block 318, that the desired material in the secondary load region 202 was mined out, then a determination is made that the bucket 106 is dumping, shown in fourth control block 316, and the method 300 is repeated. If the desired material in the secondary load region has not been mined out then the method determines that the bucket 106 is loading, shown in a fifth control block 320. Finally, the method 300 determines the type of material that was loaded into the bucket 106, shown in a sixth control block 322.

Figure 6:
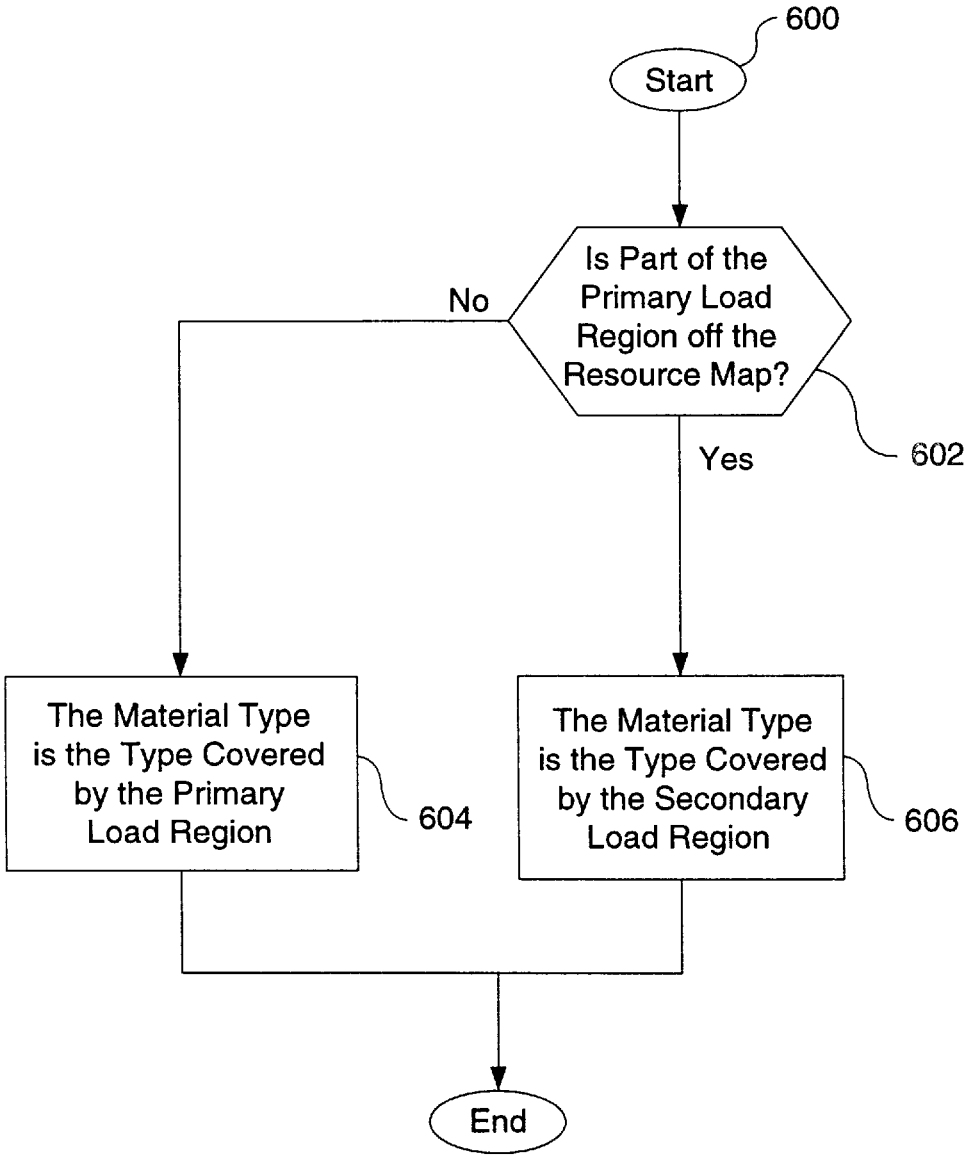
FIG. 6 is a high level flow diagram illustrating a method to determine the type of material loaded.

Reference is now made to FIG. 6, where a method to determine the type of material loaded into the bucket 106 is illustrated. In a first decision block 602, the method 600 determines if the primary load region 204 is located off of the resource map 110, e.g., in a situation where the cable shovel 102 is loading material located along a side of the resource map 110 and the location of the maximum extension of the bucket 106 is not on the resource map 110. If the primary load region 204 is located off the resource map 110, then the method 600 determines, in a first control block 604, that the material loaded is of the type that is located in the area of the secondary load region 202 located on the resource map 110. Otherwise, the method 300 determines, in a second control block 606, that the material loaded in the bucket 106 is of the type located in the primary load region 204.

The present invention is embodied in a microprocessor based system (not shown) which utilizes arithmetic units to control process according to software programs. Typically, the programs are stored in read-only memory, random-access memory or the like. The method 300 disclosed in the present invention may be readily coded using any conventional computer language.

Industrial Applicability

The present invention provides a method for monitoring a work cycle of a mobile machine 102 on a land site 104. In the preferred embodiment, the mobile machine 102 includes a cable shovel. The disclosed method is capable of determining when the cable shovel 102 loads and dumps material, and also the type of material that was loaded. This information constitutes the work cycle of the cable shovel 102. The information can be conveyed to the operator of the cable shovel 102 through the use of a display (not shown). A resource map 110 for the land site 104, such as shown in FIG. 1, is provided to the operator through a display. The display is capable of showing the location of the cable shovel 102 on the resource map 110, the location of different types of material to be mined and the topography of the land site 104. As the cable shovel 102 mines the land site 104, the disclosed invention monitors the work cycle of the cable shovel 102. Monitoring the work cycle enables the cable shovel 102 to autonomously keep track of how many times a particular truck is loaded, and with what type of material. Then, when the operator is finished loading a particular truck, he may simply push a transmit button that transmits information regarding the contents of the loaded truck, to a central tracking facility. This alleviates the need for the operator to perform the cumbersome task of tracking the current contents of the truck being loaded.

Other aspects, objects and advantages of the present invention can be obtained from a study of the drawings, the disclosure and the appended claims.

We claim:

1. A method for monitoring a work cycle of a mobile machine for moving material on a land site, said mobile machine having a body and a bucket, said body being adapted to rotate about a fixed point of reference, including the steps of:

determining an angular velocity of said body;

determining that said body is stopped in response to said angular velocity being less than a specified amount;

determining a duration of time said body is stopped; and determining said work cycle in response to said duration of time.

2. A method as set forth in claim 1 wherein the step of determining said work cycle includes the step of determining that said bucket performed a dumping operation in response to said duration of time being less than a specified amount.

3. A method as set forth in claim 2 wherein the step of determining said work cycle includes the step of determining that said bucket performed a loading operation in response to said duration of time being larger than a specified amount.

4. A method as set forth in claim 3, including the steps of:

determining a resource map for said land site; and defining a potential load region as a portion of said land site located between said body and a maximum extension of said bucket, said potential load region being determined in response to said body being stopped, said potential load region including a primary load region and a secondary load region, said secondary load region being adjacent to said mobile machine, and said primary load region being adjacent to, and overlapping said secondary load region opposite of said mobile machine.

5. A method as set forth in claim 4, wherein the step of determining said work cycle includes the step of determining that said bucket performed a dumping operation in response to said duration of time being less than a specified amount and said material type in said secondary load region being mined out.

6. A method as set forth in claim 5, including the step of identifying a type of said material that is loaded in said bucket.

7. A method as set forth in claim 5, including the steps of:

determining that a dumping operation occurred in response to determining said duration of time being greater than a specified amount and said material in said secondary load region being mined out; and determining that a loading operation occurred in response to determining said duration of time being greater than a specified amount and said material in said secondary load region not being mined out.

8. A method as set forth in claim 4, including the steps of:

determining a location of said primary load region on said resource map in response to determining that said secondary load region has not been mined out;

determining that said material loaded in said bucket consists of material from said secondary load region in response to said location of said primary load region being off of said resource map; and determining that said material loaded in said bucket consist of material from said primary load region in response to said location of said primary load region being within said resource map.

9. A method as set forth in claim 1, wherein the step of determining an angular velocity includes the step of determining a position of said body in response to receiving a GPS signal.

10. A method for monitoring a work cycle of a mobile machine for moving material on a land site, said mobile machine having a body and a bucket, said body being adapted to rotate about a fixed point of reference, including the steps of:

determining an angular velocity of said body;

determining said body is stopped in response to said angular velocity being less than a specified amount;

determining a duration of time said body is stopped;

determining a resource map for said land site;

defining a potential load region as a portion of said land site located between said body and a maximum extension of said bucket, said potential load region being determined in response to said body being stopped, said potential load region including a primary load region and a secondary load region, said secondary load region being adjacent to said mobile machine, and said primary load region being adjacent to, and overlapping said secondary load region opposite of said mobile machine;

determining said bucket performed a dumping operation in response to said duration of time being less than a specified amount and said material type in said secondary load region being mined out;

determining said bucket performed a loading operation in response to said duration of time of being one of greater than and equal to said specified amount and said secondary load region not being mined out; and determining the work cycle in response to said duration of time, said dumping operation and said loading operation.

11. A method for monitoring a work cycle of a mobile machine for moving material on a land site, said mobile machine having a body and a bucket, said body being adapted to rotate about a fixed point of reference, including the steps of:

determining an angular velocity of said body;

determining that said body is stopped in response to said angular velocity being less than a specified amount;

determining a duration of time said body is stopped; and, identifying one of a loading and a dumping portion of a work cycle in response to said duration of time.

12. A method as set forth in claim 11, further including the steps of determining a potential load region in response to said body being stopped, wherein the step of identifying said one of a loading and dumping portion further includes the step of identifying said one of a loading and dumping portion in response to said duration of time and said potential load region.

13. A method as set forth in claim 12, further including the steps of determining said potential load region is one of mined out and not mined out.

14. A method as set forth in claim 13, further including the step of:

identifying a loading portion of said work cycle in response to said potential load region being not mined out, and said duration of time being greater than a specified amount.

15. A method as set forth in claim 11, wherein the step of determining said angular velocity further includes the step of determining said angular velocity utilizing a positioning system.

16. A method as set forth in claim 15, wherein the step of determining said angular velocity utilizing a positioning system further includes the step of determining said angular velocity utilizing a plurality of position signals received from a remote source, said position signals being used to determine a plurality of positions of said body.

17. A method, as set forth in claim 11, further comprising the step of determining a dumping portion of a work cycle in response to said duration of time being less than a specified amount.

* * * * *